US006868762B2

(12) United States Patent
Van De Velde Keyser

(10) Patent No.: US 6,868,762 B2
(45) Date of Patent: Mar. 22, 2005

(54) AUTOMATIC CUTTING AND STACKING DEVICE FOR SHAPED BLANKS AND METHOD OF USE

(75) Inventor: Herbert Sybrant Van De Velde Keyser, Lochristi (BE)

(73) Assignee: Solutia Europe S.A./N.V., Brussels (BE)

( * ) Notice: Subject to any disclaimer, the term of this patent is extended or adjusted under 35 U.S.C. 154(b) by 0 days.

(21) Appl. No.: 10/081,314

(22) Filed: Feb. 21, 2002

(65) Prior Publication Data

US 2002/0078807 A1 Jun. 27, 2002

Related U.S. Application Data

(63) Continuation of application No. 09/486,712, filed as application No. PCT/EP98/05678 on Sep. 8, 1998, now abandoned.

(30) Foreign Application Priority Data

Sep. 23, 1997 (EP) ..... 97870144

(51) Int. Cl.[7] ..... B65H 35/04; B26D 7/26

(52) U.S. Cl. ..... 83/23; 83/42; 83/56; 83/86; 83/94; 83/165; 83/167; 83/436.3; 83/443; 83/486.1; 83/559; 83/614; 83/948

(58) Field of Search ..... 83/86, 508, 614, 83/23, 34, 42, 56, 94, 165, 167, 240, 353, 436.3, 401, 438, 439, 443, 406.1, 508.2, 559, 578, 636, 948

(56) References Cited

U.S. PATENT DOCUMENTS 1,279,880 A * 9/1918 Krafft ..... 83/559 X
3,696,186 A * 10/1972 Stark et al. ..... 264/292
3,859,152 A * 1/1975 Brey et al. ..... 83/614 X
4,383,458 A * 5/1983 Kitai et al. ..... 83/405
4,554,713 A * 11/1985 Chabal ..... 26/51
4,555,967 A * 12/1985 Jumel ..... 83/559 X
4,809,754 A * 3/1989 Barnes ..... 144/392
5,087,502 A * 2/1992 Esposito et al. ..... 428/156
5,092,459 A * 3/1992 Uljanic et al. ..... 206/320
5,137,673 A * 8/1992 Bourcier et al. ..... 264/151
5,186,090 A * 2/1993 Bunch, Jr. ..... 83/341
5,611,253 A * 3/1997 Saito et al. ..... 83/383
5,787,778 A * 8/1998 Saito et al. ..... 83/383
5,844,772 A * 12/1998 Lee et al. ..... 361/683

FOREIGN PATENT DOCUMENTS

EP 0 317 545 * 5/1989
EP 0 683 026 * 11/1995

* cited by examiner

*Primary Examiner*—Clark F. Dexter
(74) *Attorney, Agent, or Firm*—Blackwell Sanders Peper Martin LLP

(57) ABSTRACT

An automatic cutting and stacking device for arcuately shaped blanks is disclosed. The device contains a feeding table followed by a cutting unit and a stacking device. The cutting unit is movable in relation to the feeding table to thus allow a cutting perpendicular to the contour of the shaped film. The stacking unit comprises a slide plate and a movable base plate upon which the cut blanks are stacked. The height of the base plate can be adjusted/lowered in relation to the accumulating thickness of the stacking height of the cut blanks.

10 Claims, 4 Drawing Sheets

Figure 1:
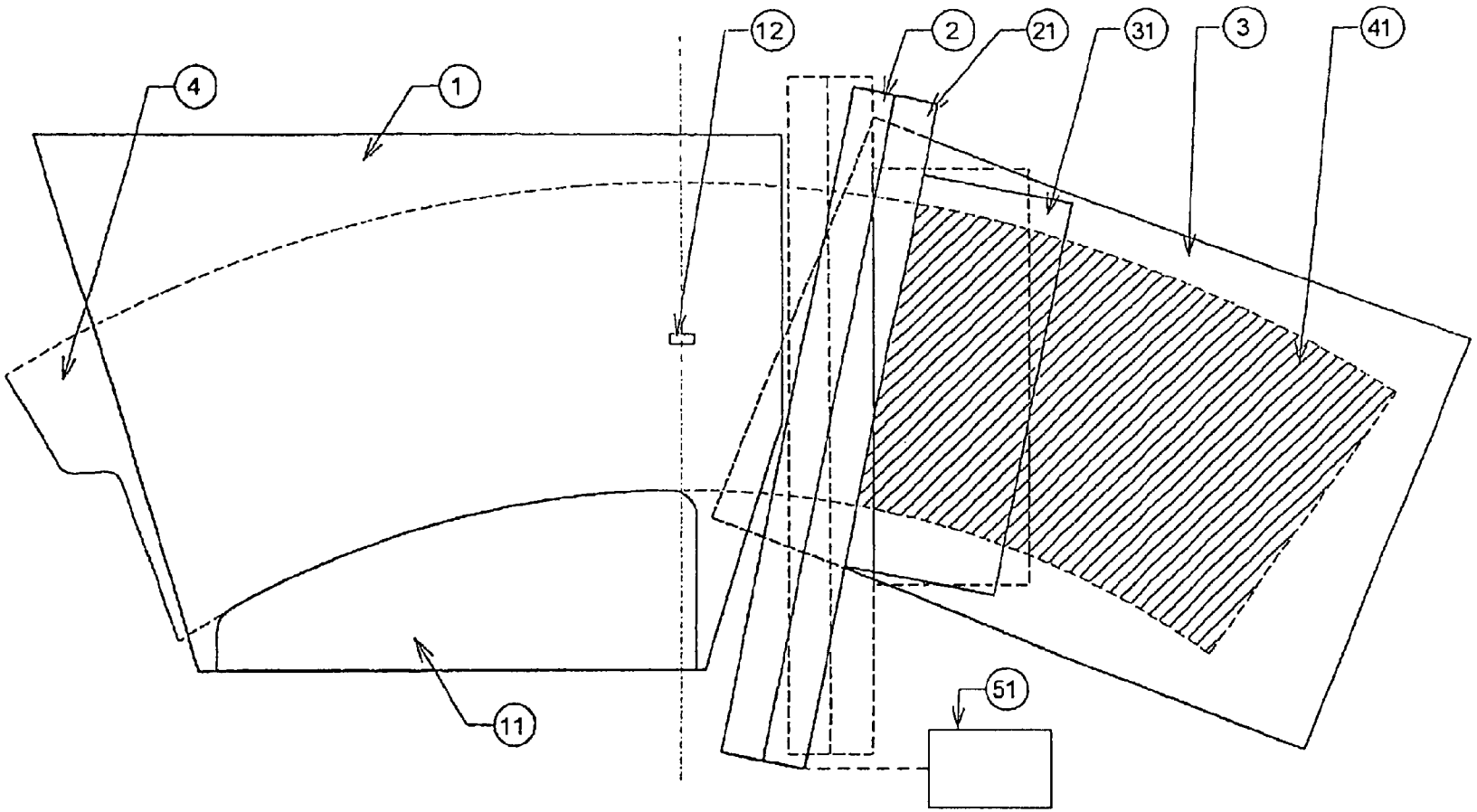

1
13
12
21
22
31
3
32
11

41

AUTOMATIC CUTTING AND STACKING DEVICE FOR SHAPED BLANKS AND METHOD OF USE

CROSS REFERENCE TO RELATED APPLICATION

This application is a continuation application which claims the priority of prior application Ser. No. 09/486,712, entitled "Automatic Cutting And Stacking Device For Shaped Blanks And Method Of Use", filed May 30, 2000, now abandoned, which is U.S. National Phase application of PCT/EP98/05678, filed Sep. 8, 1998, entitled "Automatic Cutting And Stacking Device For Shaped Blanks And Method Of Use" which claims priority to European Patent Application 97870144.9, filed Sep. 23, 1997, entitled, "Automatic Cutting And Stacking Device For Shaped Blanks And Method Of Use" which is hereby incorporated by reference into this application.

This invention relates to an automatic cutting and stacking device for cut shaped blanks and method of use. The equipment is beneficially suitable for the manufacture and handling of cut shaped interlayer blanks. The equipment of this invention comprises: a feeding mechanism generally embodying a surface that feeds accurately a film under a set angle along a set arc into the cutting unit; a cutting unit that cuts the shaped film squarely accross its circular contours; and a stacking system that stacks, in a single planar movement, the blanks at their cut positions.

Cut shaped blanks are used in automobile windshields, in particular windshields having a tinted band along the upper side. To that effect, the originally straight web, of for example polyvinyl butyral interlayer, is stretched into a curved web that fits the shape of the windshield. The so curved web is subsequently cut to produce the appropriate cut shaped blanks which can be used as interlayer between two sheets of glass for the manufacture of laminated windshields. The cutting and the stacking of such blanks is generally performed manually, chiefly because of the non-linear shape of the blanks in casu two (opposite) sides are circular whereas the (opposite) cut sides are generally straight but not parallel.

The prior art, including industrial practice, relating to the manufacture of shaped blanks is well established and known to be economically marginal. Because of difficulties attached to the nonlinear shape of the blanks, the cutting and/or stacking of the blanks is generally done, in total or partially, manually. Past efforts to automate the cutting and/or stacking operations of blanks have led to an equipment outlay whereby a series of individual machines were installed to subsequently perform the: feeding operation; cutting operation; removal of the cut blanks; and the stacking of the cut blanks. Such known manufacturing arrangements are capital intensive, require large amounts of clean room, floor space and operator's assistance and are, inherently, subject to substantial model change-over difficulties.

It is therefore a first object of this invention to make available equipment capable of automatically cutting arcuately shaped film and stacking of the cut blanks. It is another object of this invention to provide equipment capable of continously and automatically, substantially non-manually, cutting and stacking circularly contoured cut-shaped blanks. It is still another object of this invention to generate a method for the continuous manufacture and automatic stacking of cut shaped blanks. The foregoing and other objects of this invention can now be met by means of a machine comprising: a feeding table; a cutting device; and an indexing table.

The invention herein thus relates to an automatic cutting and stacking device for arcuately shaped blanks comprising:

(a) a feeding table capable of feeding a set length of arcuately shaped film to a cutting device;

(b) a device that cuts the shaped film into blanks; and (c) a stacking device comprising an indexing table with an attached slide plate and a base plate.

The feeding mechanism is, in a preferred embodiment, operated by means of a feeding wheel 12 which propels a set length of film to the cutting device. The cutting device 2 can be represented by a stationary bed knife 21 combined with a traversing rotating knife 22. The angle between the bed knife and the centerline of the feeding wheel shall be adjustable to thus achieve perpendicular cuts for any selected radius. Indexing table 33, provided with base plate 3, is lowered, in a manner synchronized to the operation of the cutting device, by increments substantially corresponding to the thickness of the cut shaped blanks. The base plate supporting the formed stack of cut blanks can be rolled off the indexing table and thus serve for whatever application and/or treatment can be in order.

Figure 2A:
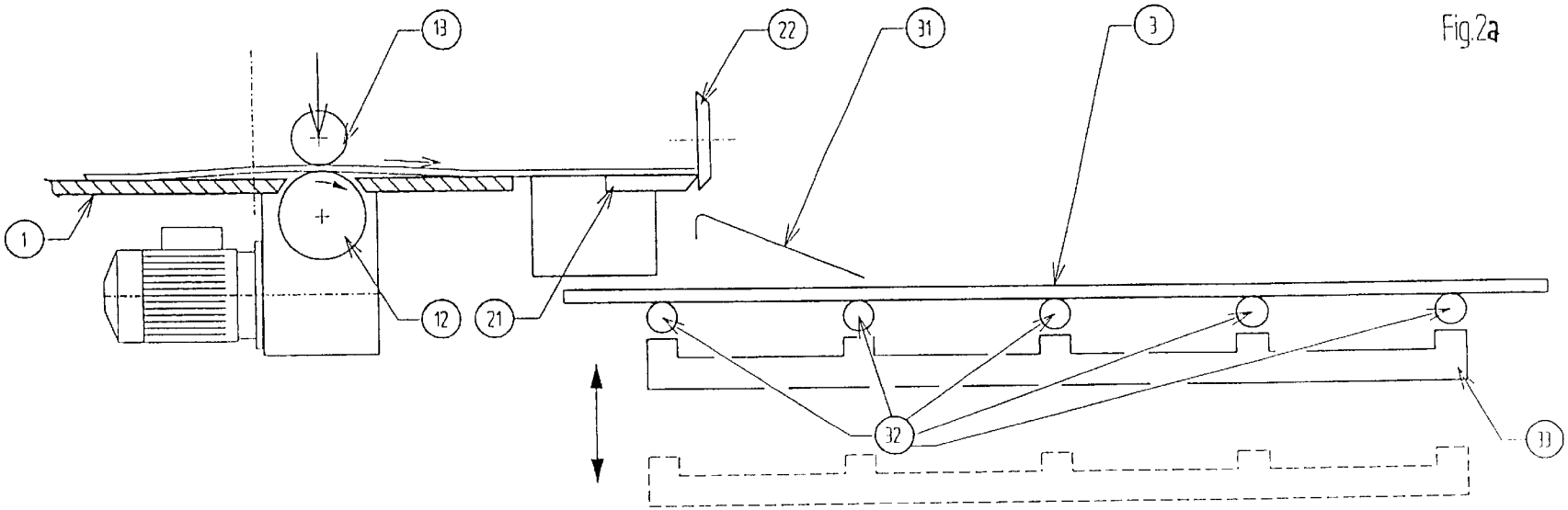
Figure 2B:
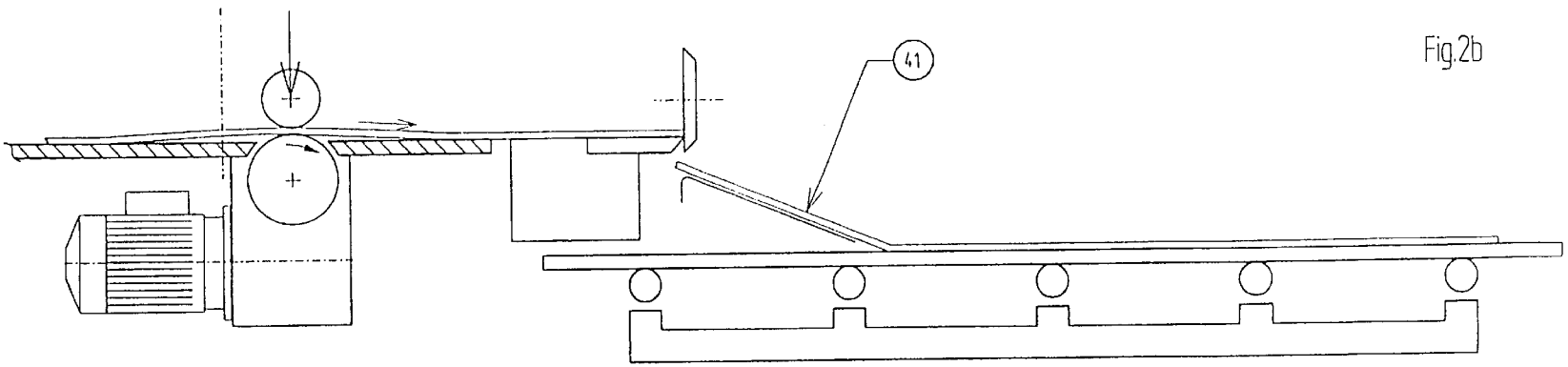
Figure 2C:
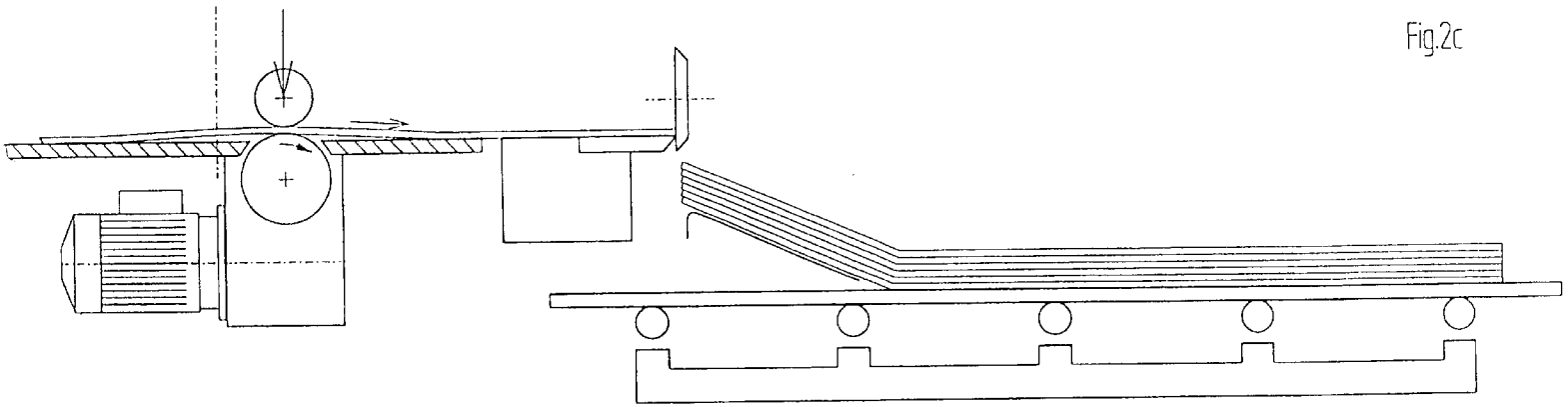
Figure 2D:
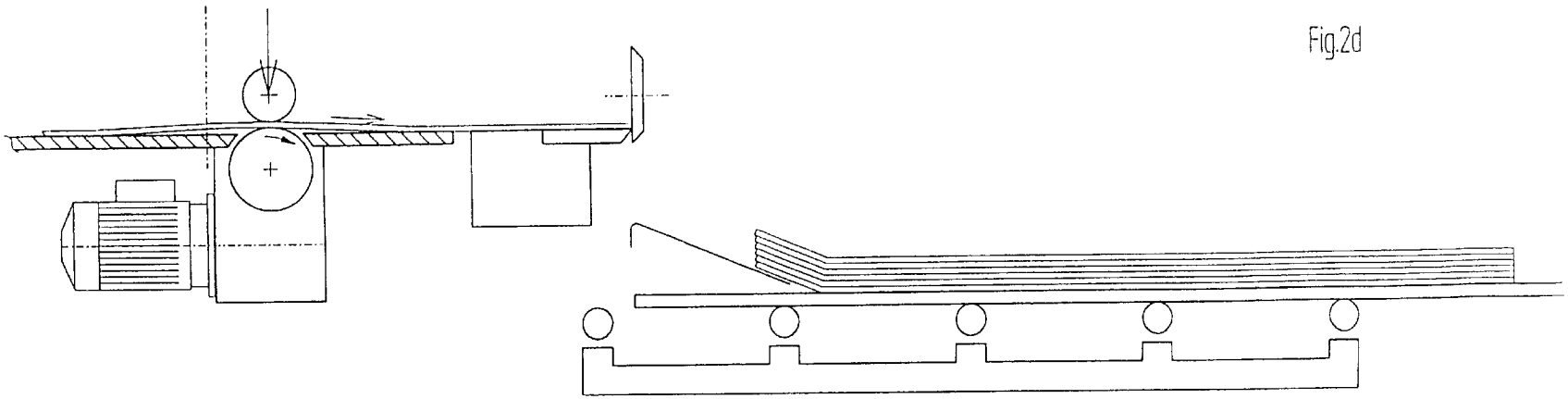
Figure 2E:
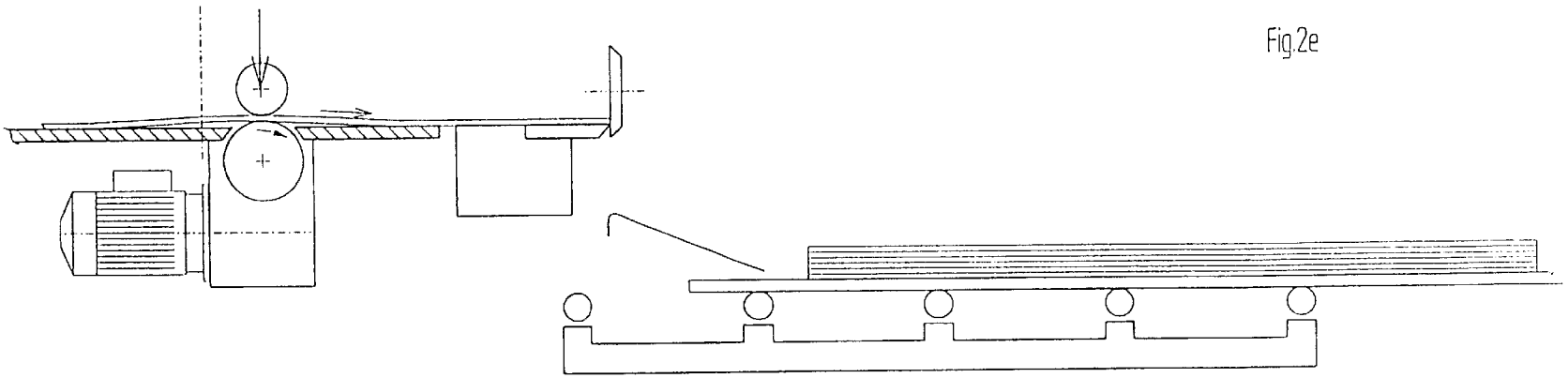
Figure 2F:
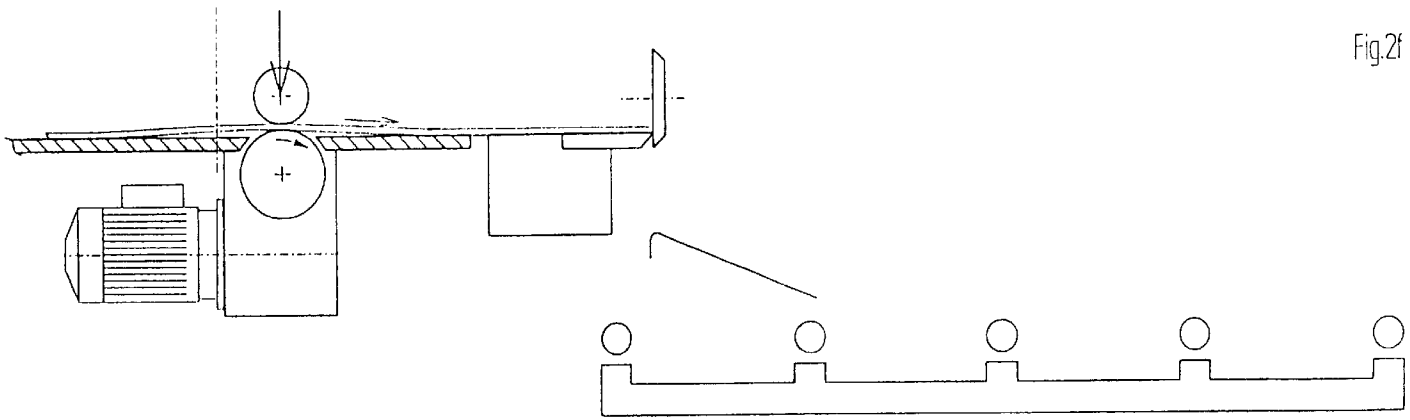

In describing the invention, reference will be made to the accompanying drawings wherein:

FIG. 1 is a plan view representing the automatic cutting and stacking device in accordance with the invention herein;

FIGS. 2*a*; 2*b*; 2*c*; 2*d*; 2*e*; and 2*f* represent sectional views of the invention with respect to the operational sequence of the cutting and stacking device herein. FIG. 2*a* represents starting position with empty base plate 3. FIG. 2*b* shows the first cut blank 41. FIG. 2*c* shows a stack of cut blanks accumulated on slide plate 31 and on the base plate. FIG. 2*d* shows the removal of the base plate with stack of cut blanks. FIG. 2*e* shows the stack on the base plate after being removed from the slide plate. FIG. 2*f* shows the automatic stacking device after removal of the base plate carrying the stack of cut blanks.

The invention is described and explained under particular reference to the drawings. The feeding table 1, FIG. 1, is equipped with a system that positions the advancing forward edge of the shaped film in such a way into the cutting device that the cut will produce a blank of the desired size. Feeding wheel 12 propels a set length of film along a guide 11 to the cutting device. Pressure roller 13 presses the shaped film against the feeding wheel to thus prevent slippage which could alter the set angle for the blank. A separate guide shall be used for each radius.

The cutting device 2, can be represented by any type of cutting mechanism which is generally known to be suitable for the automatic cutting of plastic films. The cutting mechanism generally comprises a stationary bed knife and a knife, for example a guillotine knife, or preferably a rotating knife, which runs along the bed knife to thus perform a scissors cut. In a preferred execution, one can use a stationary bed knife 21 combined with a traversing rotating knife 22. The position, particularly the rotational orientation, of the cutting unit comprising the stationary bed knife and the counter knife can be a adjusted independently of and in relation to the feeding table by means of any suitable cutting unit adjusting mechanism 51 routinely available such as about a vertical axis. The angle between the bed knife and the center line of the feeding wheel is adjustable consequently to allow a perpendicular cut for all radii. In a preferred adjustment of the cutting unit, the angle is, for shaped films having a radius between 1 and 8 meters, from 0° to about 18°. Differently expressed, the cutting angle is such that the cut is effected to yield a cut perpendicular to the edges of the contoured film. The feeding wheel 12 is located as close as practical to the bed knife, i.e., the exit border of the feeding table 1.

The blanks as they are cut from the contoured film are collected on base plate 3. In more detail, the contoured film is passed through the cutting device via the slide plate 31 to the base plate until the selected length to be cut is reached. The cut separates the blank from the contoured film. The cut blanks are then superposed on the base plate. To control the height of the cut blanks to avoid obstruction to oncoming blanks, the indexing table 33 is lowered in a manner synchronized to the operation of the cutting device. The indexing increments substantially correspond to the thickness of the cut shaped films. The increments can correspond to the thickness of one or more cut shaped blanks. It was found that (individual) indexing increments corresponding to two to ten times the thickness of the cut shaped blanks can be preferred.

The slide plate 31 serves to overcome the height difference between bed knife 21 and base plate 3. The slide plate is permanently attached to the indexing table 33. The top of the indexing table is equipped with rollers 32 to thus facilitate the handling of the base plate, in particular the base plate onto which the cut blanks are stacked. While removing the base plate with the blanks, the small section of the blanks resting on the slide plate, follow the movement of the base plate to thus form a square stack of blanks after having left the slide plate.

The base plate carrying the stack of cut blanks is now ready for use on the laminating line or whatever application may be in order.

A very preferred feeding table herein can be represented by the treatment table in accordance with copending European patent application EP-A-97870135.7, filed Sep. 12, 1997. The shaped films which can be handled by means of the automatic cutting and stacking device herein are preferably represented by plasticized polyvinyl butyryl interlayer films. Such films can be shaped by known manufacturing techniques, most preferably in accordance with the dual umbrella shaper technology as described in EP-A-0.685.316.

What is claimed is:

1. Automatic cutting and stacking apparatus for producing and stacking arcuately shaped blanks comprising:

(a) a feeding table comprising a surface, at least one guide defining an arcuate path, and a feeding wheel for propelling a set length of arcuately shaped film along said surface and along said arcuate path guided by said at least one guide to a cutting device;

(b) the cutting device being adjustably attached to said feeding table for adjustment in a direction generally parallel to said surface to cut the arcuately shaped film propelled from the feeding table perpendicular to the edges of said arcuately shaped film; and (c) a stacking device connected to said feeding table to receive the cut arcuately shaped film from said cutting device, said stacking device comprising an indexing table with an attached slide plate and a base plate.

2. The apparatus in accordance with claim 1 wherein said feeding table is provided with said feeding wheel and a pressure roller, and said cutting device comprises a stationary bed knife combined with a traversing rotating knife.

3. The apparatus in accordance with claim 2 wherein said at least one guide comprises an arcuate guide surface to guide to the arcuately shaped film.

4. The apparatus in accordance with claim 2 wherein said cutting device is independently adjustable in relation to the feeding table about an axis perpendicular to the plane of the feeding table and arcuately shaped film disposed thereon by a cutting unit adjusting mechanism.

5. The apparatus in accordance with claim 4 wherein the cutting device is independently adjustable in relation to the feeding table by the cutting unit adjusting mechanism over a domain represented by an angle from 0° to 18°.

6. A method for the continuous manufacture and automatic stacking of cut shaped blanks from arcuately shaped film by an automatic cutting and stacking apparatus, said automatic cutting and stacking apparatus comprising a feeding table having a surface, a feeding wheel and at least one guide defining an arcuate path, a cutting device adjustably attached to said feeding table for adjustment in a direction generally parallel to said surface to yield a cut perpendicular to the edges of the arcuately shaped film, and a stacking device connected to said feeding table in a manner to receive and stack blanks, said method comprising:

placing arcuately shaped film on to said surface of said feeding table, propelling the arcuately shaped film from said feeding table to said cutting device using said feeding wheel and guiding the arcuately shaped film as it moves along said surface of said feeding table and along said arcuate path with said at least one guide, cutting the arcuately shaped film perpendicularly to the edges of said arcuately shaped film with said cutting device to produce said cut shaped blanks; and stacking the blanks using said stacking device, said stacking device comprising a slide plate attached to the cutting device for receiving the blanks from said cutting device, a base plate attached to the slide plate to receive and stack the blanks, and an indexing table underneath said base plate.

7. The method of claim 6 wherein slippage of the shaped film is reduced by utilizing a pressure roller to press the shaped film against the feeding wheel and wherein said cutting device comprises a stationary bed knife combined with a traversing rotating knife.

8. The method of claim 7 wherein said at least one guide comprises an arcuate guide surface to guide the arcuately shaped film.

9. The method of claim 7 further comprising independently adjusting the cutting device in relation to the feeding table about an axis perpendicular to the plane of the feeding table and arcuately shaped film disposed thereon.

10. The method of claim 9 wherein the cutting device is independently adjustable in relation to the feeding table by a cutting unit adjusting mechanism over a domain represented by an angle from 0° to 18°.

* * * * *

UNITED STATES PATENT AND TRADEMARK OFFICE

CERTIFICATE OF CORRECTION

PATENT NO. : 6,868,762 B2
DATED : March 22, 2005
INVENTOR(S) : Herbert Sybrant Van De Velde Keyser It is certified that error appears in the above-identified patent and that said Letters Patent is hereby corrected as shown below:

Column 1,
Line 26, delete "accross" and replace with -- across --;
Line 60, delete "continously" and replace with -- continuously --

Column 2,
Line 56, prior to "adjusted" delete "a";

Column 3,
Line 34, delete "butyryl" and replace with -- butyral --

Signed and Sealed this

Second Day of August, 2005

JON W. DUDAS
*Director of the United States Patent and Trademark Office*